US006394443B1

(12) United States Patent
Vedoy et al.

(10) Patent No.: US 6,394,443 B1
(45) Date of Patent: May 28, 2002

(54) DROP TABLE ATTACHMENT FOR SHEET FEEDING MACHINE

(75) Inventors: Arild Vedoy, White Bear Lake; Mark Nordling, Crystal, both of MN (US)

(73) Assignee: Multifeeder Technology, Inc., White Bear Lake, MN (US)

( * ) Notice: Subject to any disclaimer, the term of this patent is extended or adjusted under 35 U.S.C. 154(b) by 0 days.

(21) Appl. No.: 09/705,204

(22) Filed: Nov. 2, 2000

(51) Int. Cl.[7] ..... B65H 83/00

(52) U.S. Cl. ..... 271/3.14; 271/210; 271/213; 271/221; 414/790.6; 414/790.8

(58) Field of Search ..... 271/210, 213, 271/221, 222, 3.14, 218; 414/789.5, 790, 790.1, 790.5, 790.6, 790.8; 221/2, 7, 206, 207

(56) References Cited

U.S. PATENT DOCUMENTS

| | | | | | |
|---|---|---|---|---|---|
| 2,606,483 | A | * | 8/1952 | Forbes | 414/790.8 |
| 2,626,147 | A | * | 1/1953 | Gjostein | 271/222 |
| 3,027,817 | A | * | 4/1962 | Loeffler | 414/790.5 |
| 3,028,980 | A | * | 4/1962 | Lindqvist | 414/790.8 |
| 3,205,794 | A | * | 9/1965 | Califano et al. | 414/790.6 |
| 3,297,318 | A | * | 1/1967 | Knecht | 271/222 |
| 4,318,541 | A | * | 3/1982 | Nagel et al. | 271/222 |
| 4,890,825 | A | * | 1/1990 | McCormick et al. | 271/221 |
| 4,983,096 | A | * | 1/1991 | Bodewein | 414/789.5 |
| 6,050,563 | A | | 4/2000 | Vedoy et al. | 271/10.07 |

FOREIGN PATENT DOCUMENTS

| | | | | |
|---|---|---|---|---|
| SE | 0307769 | * | 1/1969 | 414/790.8 |

* cited by examiner

*Primary Examiner*—H. Grant Skaggs
(74) *Attorney, Agent, or Firm*—Nikolai & Mersereau, P.A.

(57) ABSTRACT

A drop table is used for accumulating a desired number of sheets of items in a bundle and then dropping the bundle onto a conveyor belt. The drop table has a plurality of rods acting as a floor in a collection box. When the drop table receives a signal from a sheet feeder that the number of items desired is in the bundle the rods are withdrawn from beneath the collection box and the bundle drops to a conveyor belt. The rods are then moved back into position for receiving more sheets to form another bundle and the drop table signals the sheet feeding machine to send more sheets to the collection box. The collection box may have a vibrating jogger to align the sheets into a squared bundle on one axis and a tamping foot to align the sheets into a squared bundle on a second axis. The drop table can accumulate sheets in a squared bundle quickly without jamming and release the bundle onto a conveyor below the collection box.

15 Claims, 4 Drawing Sheets

DROP TABLE ATTACHMENT FOR SHEET FEEDING MACHINE

BACKGROUND OF THE INVENTION

1. Field of the Invention

This invention relates to counting, bundling, and dropping sheet like articles such as paper, greeting cards, envelopes.

2. Description of the Related Art

Bundling of product has been accomplished by placing product directly into boxes or putting items between lugs on a moving belt. Coordinating these systems with the flow of product to ensure accurate counts and providing tight, neat packaging has been a problem, particularly at high speeds.

Prior packaging systems using sheet feeding machines were subject to jamming and miss feeding due to uncoordinated movements of the sheet feeder and the infeed conveyor portions of the packaging machines, particularly during high speed operation. Providing a neat square bundle of products has heretofore proved challenging.

SUMMARY OF THE INVENTION

A sheet feeding device is affixed above a drop table, wherein the sheet feeder is supplied with a stack of items to be counted into batches and delivered to the drop table. When the sheet feeder has added a known number of items to a stack on the drop table the drop table receives a signal from a host machine to drop the batch onto an infeed conveyor leading to a product wrapper. A series of rods, serving as a floor under the bundle of items, is withdrawn from beneath the bundle allowing the bundle to drop onto the infeed conveyor belt. A signal from the host machine sent to a controller in the drop table tells the controller to activate a motor for withdrawing the rods from beneath the bundle. The motor then returns the rods to their original position for catching the items and signals the sheet feeder to begin sending new items to the drop table.

When the sheets are added to the batch at high speed, they are squared up into a tight package by a vibrator on the side of the sheets to align the sides of the sheets and by a tamper on the back of the sheets to align the sheets lengthwise.

The sheets of a batch can be accurately counted by the sheet feeder as the sheets are fed into the collection box. Since the collection box does not move relative to the sheet counter, it will count the batches and deliver them more reliably without jamming. The speed of counting and collecting can be increased since there is no coordination with a moving target such as a passing box or a space between lugs on a moving conveyor.

When the count is finished, the batch is dropped onto a moving belt for further packaging steps, such as overwrapping with film or the like.

OBJECTS OF THE INVENTION

It is an object of the invention to provide a machine for batching sheet items into bundles of a predetermined count and delivering the bundles to a take-away conveyor.

It is an object of the invention to provide a faster batching.

It is an object of the invention to prevent jamming.

It is an object of the invention to provide a batch, which is squared for tighter packaging.

It is an object of the invention to provide a means to jog the product as it is being batched to provide a squared up batch of sheets.

It is an object of the invention to provide a means to tamp the product as it is being batched to provide a squared up batch of sheets.

Other objects, advantages and novel features of the present invention will become apparent from the following detailed description of the invention when considered in conjunction with the accompanying drawing.

DESCRIPTION OF THE PREFERRED EMBODIMENT

Figure 1:
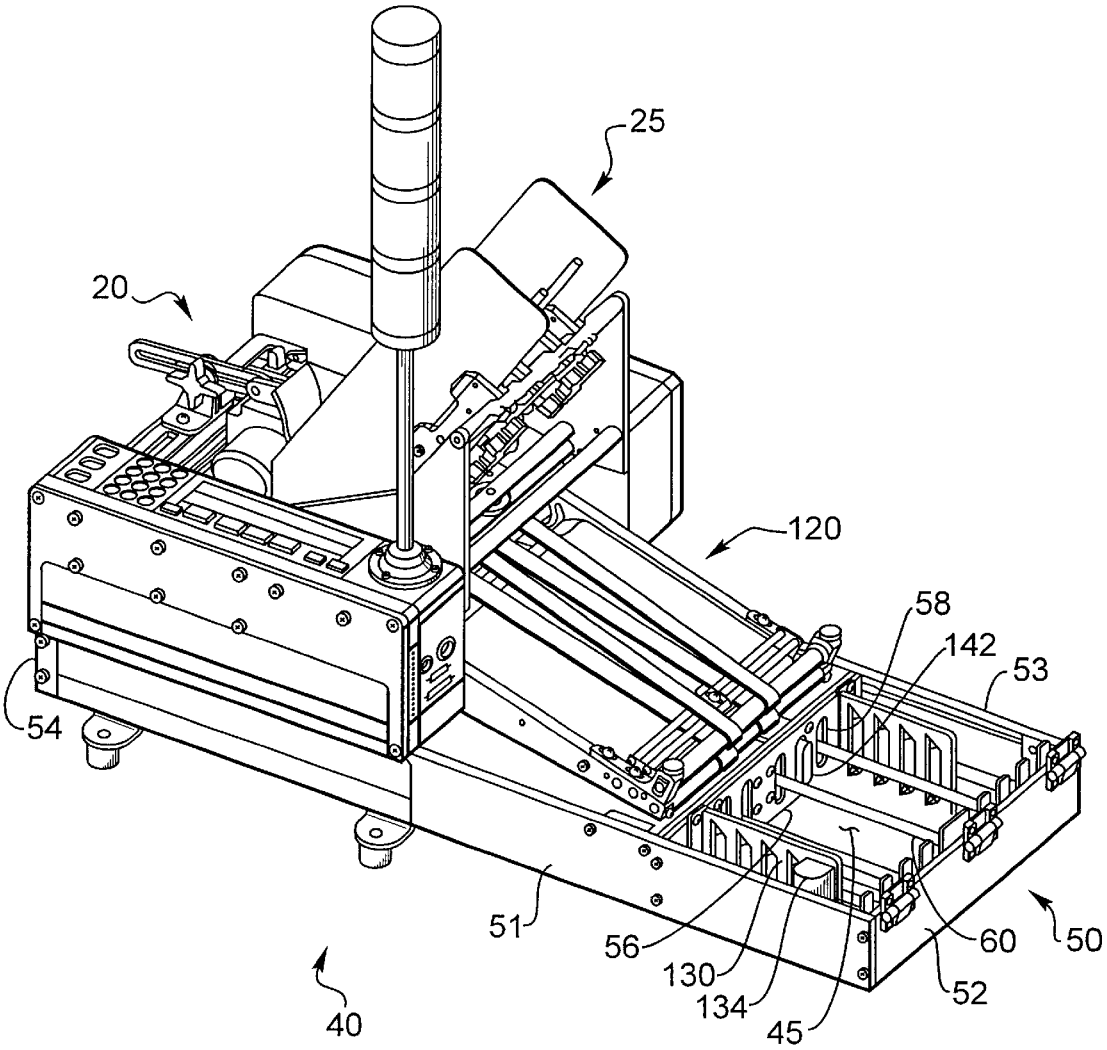
FIG. 1 is a perspective view of the sheet feeder mounted on the drop table of the present invention.
Figure 2:
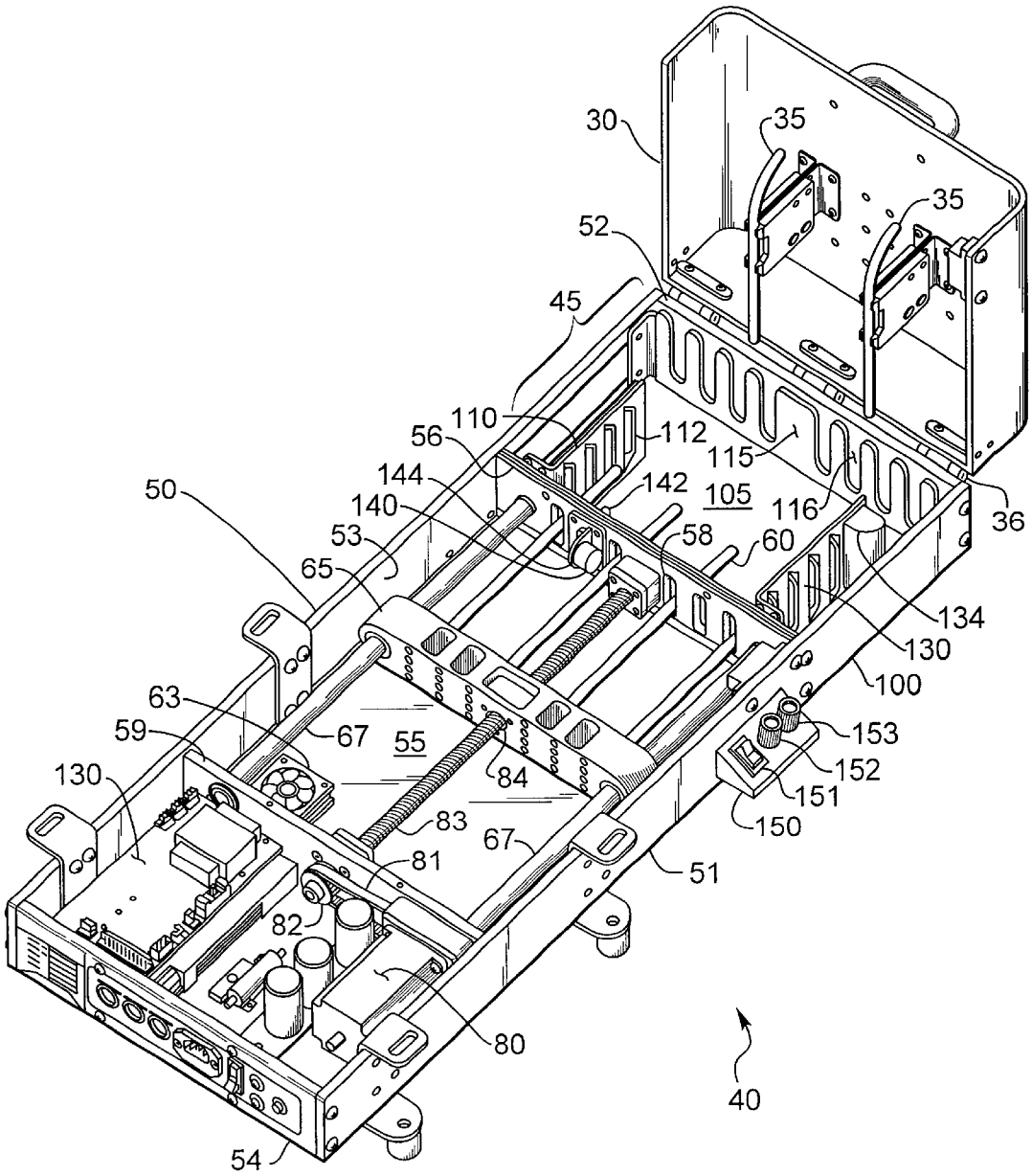
FIG. 2 is a perspective view of the drop table only.

In order to bundle a specified number of sheets or other items such as greeting cards, envelopes, sheets of paper, or other items in a stack for transfer to a conveyor belt or other collector of the bundles, the sheets are first loaded into a hopper 25 on a sheet feeder 20. The sheet feeder 20 takes sheets, one by one, from the hopper 25 and counts them. The sheets are then deposited on a sheet feeder discharge conveyor 120 for deposit into the collection box 45 of drop table 40. When the preset number of sheets has been delivered to the collection box 45, the host machine 20 sends a signal to the drop table 40 to retract rods 60, allowing the sheets collected in collection box 45 to drop through the bottom of the box frame 50. A conveyor belt (not shown) or other means of removing the bundle sheets from under the drop table 40 is used to transport the bundles of sheets away from the drop table 40, making room for the next bundle when it is dropped from the drop table 40.

The rods 60 are preferably lightweight tubes to reduce their mass, and associated inertia, to allow faster activation of the retraction and return of the rods 60 with a lower power motor 80.

After the bundle is dropped, the rods 60 are again extended to provide a bottom to the collection box of the drop table 40 to the sheet feeder 20 and a signal is sent from the drop table 40 to the sheet feeder 20 to start sending more sheets to the drop table 40.

The drop table rods 60 are preferably adjustable up and down within the collection box to different depths for accommodating different batch stack heights.

The drop table 40 has a box frame 50 with parallel sidewalls 51 and 53 and end walls 52, 54 at either end perpendicular to the sidewalls. The drop table 40 also has a bottom wall 55 extending from end wall 54 to dividing wall 56.

The drop table 40 has controlling electronics 130 between end wall 54 and control wall 59. The controlling electronics 130 sends and receives signals to the sheet feeder 20 regarding the position of the rods 60 and controls the motor 80 for actuating the rods 60.

When motor 80 is turned on, it drives belt 81, which engages pulley 82 and turns lead screw 83. Lead screw 83 interacts with feed nut 84 in traveling lightweight member 65 to propagate the traveling member 65 along guide rods 67. Rods 60 attached to traveling member 65 are therefore moved within collection box 45, alternately providing a floor for sheets deposited therein or allowing the bundle of sheets to drop out of the collection box 45.

The collection box 45 sheet collecting area is bounded by dividing wall 56, side guide 110, vibration jogger 130, and product plate 115. The dividing wall 56 has apertures 58 therein for allowing rods 60 to traverse therethrough while blocking bundles of sheets from being moved beyond the dividing wall 56 when the rods 60 are being retracted. The apertures 58 are much larger than the rods 60 to leave room for air to escape from between the sheets as they descend and are collected in the bundle. The side guide 110, the vibration jogger 130, and the product plate 115 are movable within the collection box 45 to adjust for sheet sizes. Apertures 112 in side guides 110, the vibration jogger 130, and apertures 116 in product plate 115 also allow air to escape from between the sheets as they are being stacked.

A fan 63 in bottom wall 55 sucks air out of the box frame 50 and allowing the sheets to be fed faster by removing the air between the sheets as the sheets are fed into the collection box 45. The resulting faster fed helps prevent jams. The fan 63 is also used to control the temperature in the drop table 40.

A cover member 30 having adjustable sheet deflectors 35 thereon for directing the sheets from the feeder discharge conveyer 120 into the collection box 45 may be used for optimizing product flow. The cover member 30 is hingedly connected to end wall 52 on hinges 36 such that it can be opened to access the bundles or adjust the position of the side guide 110, vibration jogger 130, or the product plate 115.

Figure 3:
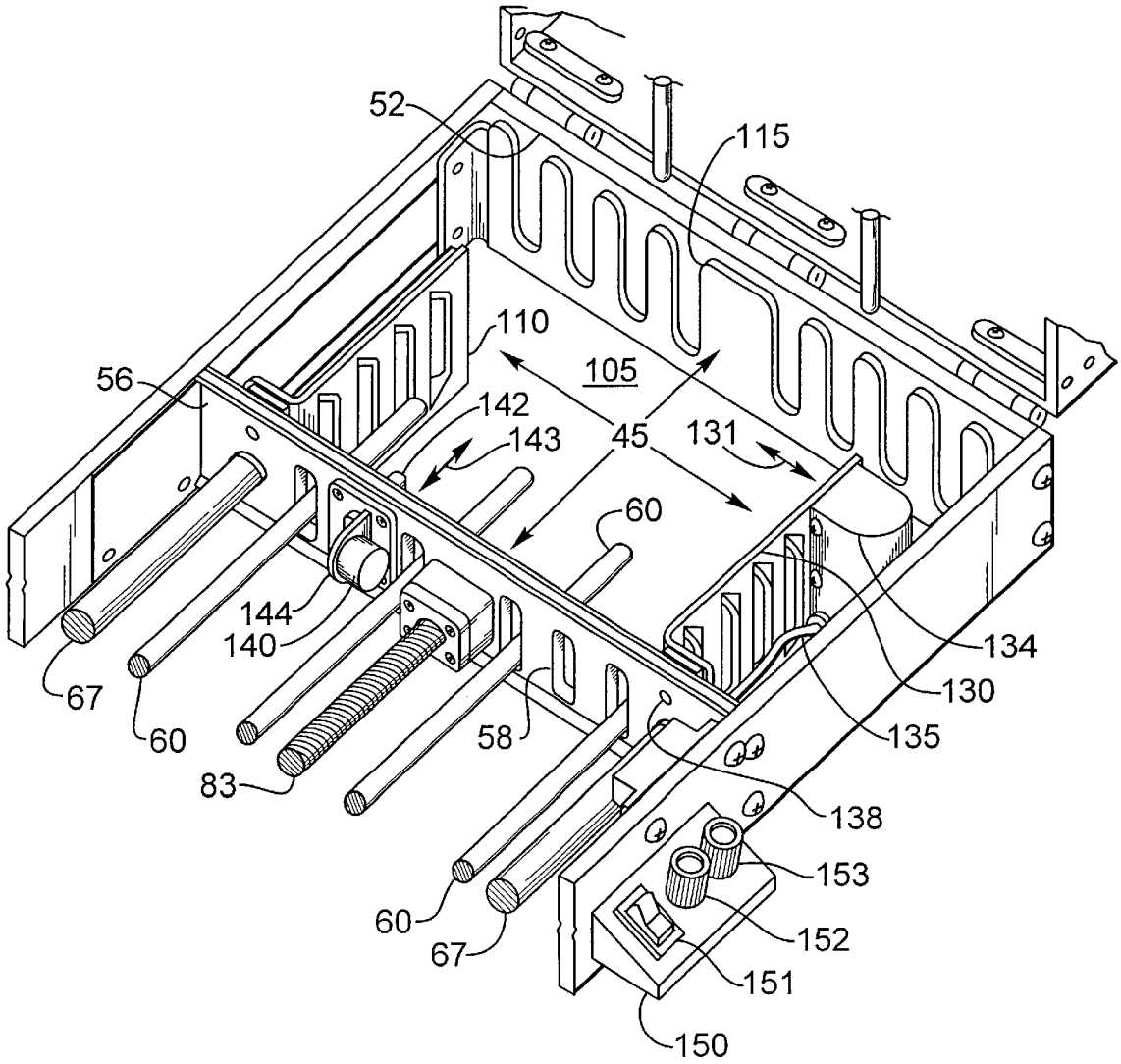
FIG. 3 is a perspective view of the drop table with a jogging sidewall and jogging foot installed.
Figure 4:
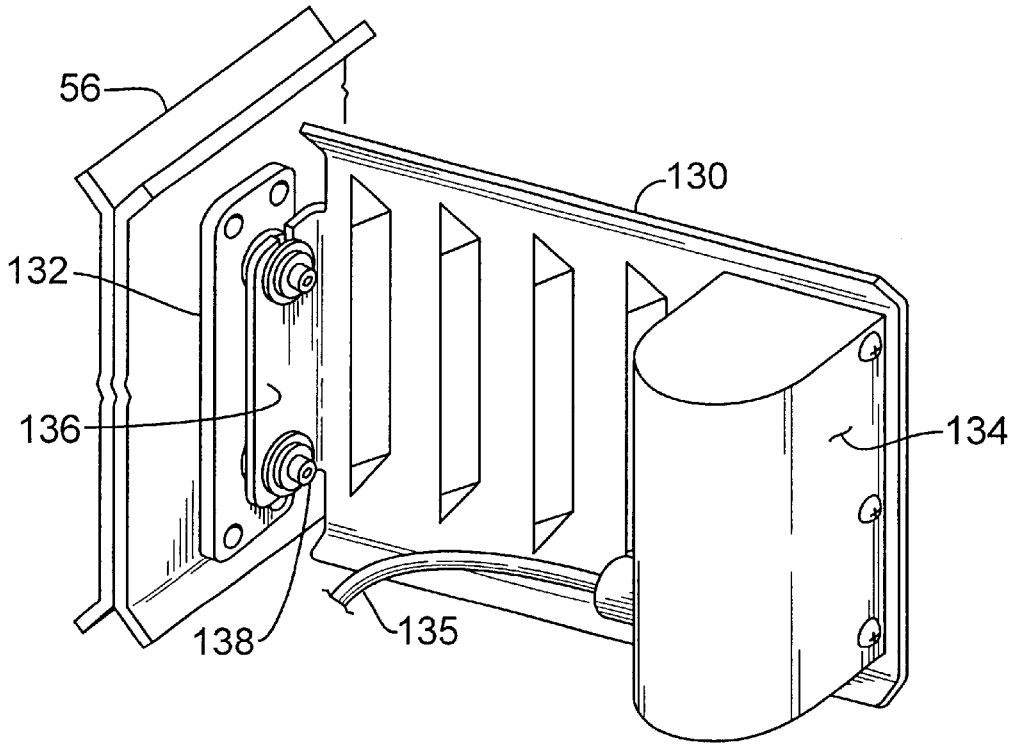
FIG. 4 is a perspective view of the vibrating jogging sidewall.

In order to provide squaring for the bundle of sheets in the collection box 45 (as best seen in FIG. 3) the vibrating jogger 130 vibrates in an arch 131 while the sheets are added to the bundle. As seen in FIG. 4 vibrating jogger 130 is attached to dividing wall 56 by bolts 138. A rubber pad mounted on bolt 138 between spacer 132 and bracket 136 on vibrating jogger 130 allows the vibrating jogger 130 to swing back and forth in arch 131 when motor 134 is on. Motor 134 gets power through cord 135 and preferably has a weight offset on a shaft for providing vibrating jogger 130 with its un-balanced forced motion.

At rest the vibratory jogger 130 is angled on the order of a few degrees from being perpendicular to dividing wall 56 and angled away from the bundle. As the sheets are added to the bundle vibratory jogger 130 taps the edges of the sheets to force them against side guide 110 to tightly pack the stack evenly. The vibrator speed is adjustable on control box 150 by turning knob 152. The speed may be varied depending on how many sheets per minute are being fed into the collection box 45. Something like two vibrations per sheet will align the sheets in the collection box 45 as the sheet enters. The vibratory jogger 130 can be set to being on at all times.

Figure 5:
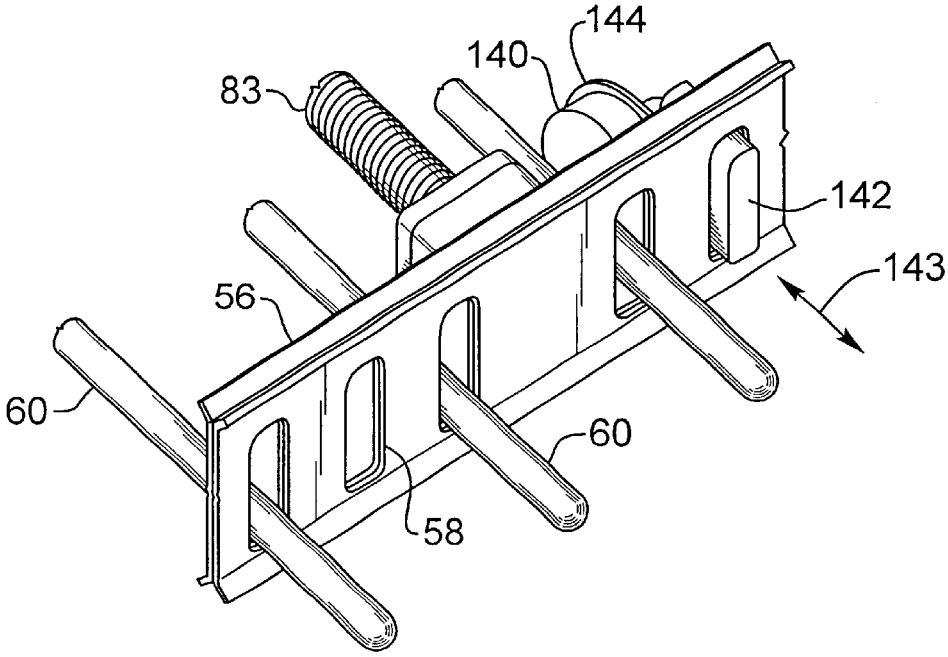
FIG. 5 is a perspective view of the tamping foot.

The sheets can also be aligned by a tamping foot 142 (as seen in FIGS. 3 and 5) set adjacent a rod member 60 and extending through an aperture 58 in dividing wall 56 into collection box 45 for on the order of 2 to 10 millimeters. The tamping foot 142 extends and retracts in direction 143 urging sheets in the bundle toward product plate 115 and forming a square bundle of evenly stacked sheets in the bundle. The tamping foot 142 extends and retracts by use of a motor, solenoid, or other actuator 140 in the tamping housing 144. The speed of the tamping foot is controlled by knob 153 on the controls 150. The tamping foot 140 is typically running when the sheets are being fed into the collection box 45 and off when no sheets are being fed into the collection box.

The control box 150 has an on and off switch 151 for turning on the motors 134 and 140. The control knobs 152 and 153 control the speed of the tamping foot 142 and the vibrating jogger 130. The vibrating jogger 130 and tamping foot 140 speed may be varied with different sheet thickness, stiffness, size, or other variables.

The vibrating jogger 130 and tamping foot 142 can be added to the collection box 45 individually or together to provide for stacking the sheets therein squarely.

As shown in the embodiment of FIG. 1 the invention is used in conjunction with the applicant's sheet feeder 20. The sheet feeder is the subject of U.S. Pat. No. 6,050,563, to Vedoy et al. issued Apr. 18, 2000 entitled "Sheet Feeder" which is attached hereto and incorporated herein by reference.

Obviously, many modifications and variations of the present invention are possible in light of the above teachings. It is therefore to be understood that, within the scope of the appended claims, the invention may be practiced otherwise than as specifically described.

What is claimed is:

1. Apparatus for preparing batches of sheet articles comprising in combination:

a sheet feeder for dispensing a predetermined number of sheet articles, one-at-a-time from a stack of such sheet articles; and a drop table controlled by the sheet feeder for accumulating the predetermined number of articles thereon as a batch and for dropping said batch onto a conveyor passing beneath the drop table upon completion of delivery of a last of the predetermined number of sheet articles onto the drop table by the sheet feeder, the drop table having, a generally rectangular box frame having a bottom wall with four mutually perpendicular side and end walls, the box frame having a dividing wall extending transverse to the side walls, the dividing wall including a plurality of apertures extending therethrough;

a plurality of rod members affixed to a traveling member in parallel, spaced-apart relation in alignment with the plurality of apertures;

means for reciprocally translating the traveling member and rod members between a first position where the rod members are retracted relative to the dividing wall and a second position where the rod members are extended relative to the dividing wall.

2. The apparatus of claim 1 wherein the means for reciprocally translating the traveling member comprises a motor driven lead screw journaled for rotation within the box frame and supporting a feed nut thereon, the rod members being coupled to the feed nut for movement therewith.

3. The apparatus of claim 1, wherein the box frame includes a collection box with a rectangular opening therethrough between one end wall and the dividing wall, the opening being traversed by the rod members when in the second position.

4. The apparatus of claim 3 and further including a sheet article diverter for deflecting sheet articles exiting the sheet feeder onto the rod members when the rod members are in the second position.

5. The apparatus of claim 4 wherein the sheet article diverter includes a cover member hinged to the one end wall, the cover member having a sheet deflector affixed to an undersurface thereof that is in a path of travel of sheet articles exiting the sheet feeder when the cover member is closed relative to the box frame.

6. The apparatus of claim 5 wherein the means for reciprocally translating the traveling member comprises a motor driven lead screw journaled for rotation within the box frame and supporting a feed nut thereon, the rod members being coupled to the feed nut for movement therewith.

7. The apparatus as in claim 6 wherein the sheet feeder provides control signals to a motor of the motor-driven lead screw.

8. The apparatus of claim 7 wherein a first control signal is delivered to the motor of the motor-driven lead screw upon the sheet feeder having dispensed said predetermined number of sheet articles, the first control signal causing the motor to retract the rod members to said first position and thereby drop a batch of sheet articles through the rectangular opening.

9. The apparatus of claim 1, wherein the sheet feeder mounts on a top portion of the box frame with an end of a discharge assembly of the sheet feeder generally vertically aligned with the dividing wall.

10. The apparatus of claim 9 and further including a pair of parallel, spaced-apart side sheet guides adapted for mounting with predetermined spacings therebetween onto the dividing wall.

11. The apparatus of claim 9, wherein the rod members comprise hollow tubes.

12. The apparatus of claim 1 wherein the drop table includes:

a vibration jogger attached to the drop table to align the sheet articles along one edge thereof as they accumulate in the drop table such that the vibration jogger acts as one side wall.

13. The apparatus of claim 12 wherein the drop table includes:

a tamping foot housing attached to the dividing wall with the tamping foot extending through one aperture of the dividing wall, the tamping foot driven by a drive means to align the sheets in the batch along one side thereof.

14. The apparatus of claim 1 wherein the drop table includes:

a tamping foot housing attached to the dividing wall with the tamping foot extending through one aperture of the dividing wall, the tamping foot driven by a drive means to align the sheets in the batch along one side thereof.

15. Apparatus for preparing batches of sheet articles comprising:

a generally rectangular box frame with a bottom wall, two side walls and two end walls perpendicular to the side walls, for accumulating a batch of sheet articles placed therein, one end wall being a dividing wall extending transverse to the side walls, the dividing wall having a plurality of apertures extending therethrough, a plurality of rod members affixed to a traveling member in parallel, spaced-apart relation in alignment with the plurality of apertures in the dividing wall, means for reciprocally translating the traveling member and rod members between a first position where the rod members are retracted relative to the dividing wall and a second position where the rod members are extended relative to the dividing wall, a vibration jogger attached to the dividing wall to align the sheet articles along one edge thereof as they accumulate in the box frame, a tamping foot housing attached to the dividing wall with the tamping foot extending through an aperture of the dividing wall, the tamping foot driven by a drive means to align sheets in the batch along one side thereof, such that when the rods are retracted relative to the dividing wall the batch drops out of the box frame.

* * * * *